US010648255B2

(12) United States Patent
Thiemann et al.

(10) Patent No.: US 10,648,255 B2
(45) Date of Patent: May 12, 2020

(54) TUBULAR STABBING GUIDE FOR TONG ASSEMBLY

(71) Applicant: Weatherford Technology Holdings, LLC, Houston, TX (US)

(72) Inventors: Bjoern Thiemann, Burgwedel (DE); Martin Liess, Seelze (DE); Karsten Heidecke, Houston, TX (US); Martin Helms, Burgdorf (DE)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 99 days.

(21) Appl. No.: 15/917,459

(22) Filed: Mar. 9, 2018

(65) Prior Publication Data

US 2019/0277100 A1 Sep. 12, 2019

(51) Int. Cl.

| | |
|---|---|
| ***E21B 19/24*** | (2006.01) |
| ***E21B 19/10*** | (2006.01) |
| ***E21B 19/16*** | (2006.01) |

(52) U.S. Cl.

CPC ..... *E21B 19/24* (2013.01); *E21B 19/10* (2013.01); *E21B 19/165* (2013.01); *E21B 19/161* (2013.01)

(58) Field of Classification Search

CPC ..... E21B 19/24; E21B 19/10; E21B 19/161; E21B 31/12

See application file for complete search history.

(56) References Cited

U.S. PATENT DOCUMENTS

| | | | |
|---|---|---|---|
| 1,945,876 A | 2/1934 | Young | |
| 3,206,259 A | 9/1965 | Curtis | |
| 3,475,038 A | 10/1969 | Matherne | |
| 3,576,062 A | 4/1971 | Matherne | |
| 3,603,387 A | 9/1971 | Schoeffler | |
| 4,295,527 A | 10/1981 | Russe | |
| 4,690,213 A | 9/1987 | Stannard et al. | |
| 5,597,041 A | 1/1997 | Robinson | |
| 6,237,684 B1 * | 5/2001 | Bouligny, Jr. | E21B 19/10 166/75.14 |
| 6,360,633 B2 | 3/2002 | Pietras | |
| 6,748,823 B2 | 6/2004 | Pietras | |
| 7,090,254 B1 | 8/2006 | Pietras et al. | |
| 7,114,235 B2 | 10/2006 | Jansch et al. | |
| 7,237,607 B2 | 7/2007 | Angman et al. | |

(Continued)

FOREIGN PATENT DOCUMENTS

| | | |
|---|---|---|
| GB | 2345073 A | 6/2000 |
| GB | 2420362 A | 5/2006 |

(Continued)

OTHER PUBLICATIONS

PCT International Search Report and Written Opinion dated Jun. 5, 2019, for International Application No. PCT/US2019/021195.

*Primary Examiner* — Brad Harcourt

(74) *Attorney, Agent, or Firm* — Patterson + Sheridan, LLP

(57) ABSTRACT

Methods and apparatus for tubular stabbing guides are presented. One example tubular stabbing guide includes a frame, a clamping assembly mounted to the frame, the clamping assembly including a plurality of guide members configured to receive a tubular and movable between an open position and a closed position, and a support plate configured to support a weight of the tubular, the support plate movable between an extended position and a retracted position.

20 Claims, 5 Drawing Sheets

(56) References Cited

U.S. PATENT DOCUMENTS

| | | | | |
|---|---|---|---|---|
| 7,832,487 | B2 | 11/2010 | Jensen et al. | |
| 7,992,634 | B2 | 8/2011 | Angelle et al. | |
| 8,550,174 | B1 | 10/2013 | Orgeron et al. | |
| 8,905,150 | B1 | 12/2014 | Pruitt et al. | |
| 8,955,620 | B2 | 2/2015 | Littlely et al. | |
| 2004/0035573 | A1 | 2/2004 | Pietras | |
| 2004/0049905 | A1* | 3/2004 | Jansch | E21B 19/164 29/428 |
| 2005/0061112 | A1 | 3/2005 | Liess | |
| 2008/0296016 | A1 | 12/2008 | Hughes et al. | |
| 2009/0056930 | A1 | 3/2009 | Angelle et al. | |
| 2012/0168227 | A1 | 7/2012 | Littlely et al. | |
| 2012/0247770 | A1 | 10/2012 | Roane et al. | |
| 2013/0140839 | A1 | 6/2013 | Quinn et al. | |
| 2015/0176349 | A1 | 6/2015 | Belik | |
| 2015/0354297 | A1 | 12/2015 | Arp et al. | |
| 2016/0186510 | A1 | 6/2016 | Vestersjo et al. | |
| 2017/0044855 | A1* | 2/2017 | Sipos | E21B 19/24 |

FOREIGN PATENT DOCUMENTS

| | | | |
|---|---|---|---|
| GB | 2472709 | A | 2/2011 |
| SU | 1198199 | A1 | 12/1985 |
| WO | 2002075097 | A2 | 9/2002 |
| WO | 2003/031766 | A1 | 4/2003 |
| WO | 2009049006 | A2 | 4/2009 |

* cited by examiner

TUBULAR STABBING GUIDE FOR TONG ASSEMBLY

BACKGROUND

Field

Embodiments of the present disclosure generally relate to a tubular stabbing guide for a tong assembly, as used, for example, in the oil and gas industry when making-up a tubular string.

Description of the Related Art

In the oil and gas industry, and in other industries where bores are drilled in the earth to access sub-surface regions, many operations require the assembly or disassembly of long strings of tubulars. For example, when drilling a bore, a drill bit will typically be mounted on the distal end of a drill string formed of many drill pipe sections or joints. Each drill pipe joint has a threaded male or pin connection on a leading end and a threaded female or box connection on a trailing end. The drill pipe sections tend to be stored, ready for deployment, in the form of stands, usually of two or three connected joints.

A drill string is made up by adding stands to the upper end of the existing string. While a stand is being added the drill string is supported and held in the rig floor with only a short length of pipe, the "stick-up", extending from the floor. A new stand is then lifted and manipulated to bring the pin connection on the upper end of the stick up. As the pin and box are brought together it is conventional to locate a stabbing guide on the box. A typical stabbing guide is formed of two hinged segments of a tough plastics material. The open segments are placed around the stick-up and then closed to form a funnel at the top of the box. The funnel guides the pin into alignment with the box, protecting the end surfaces and threads from damage.

Conventional stabbing guides are manually located and manipulated onto and from the box. However, there is a trend towards minimizing the requirement for manual operations on the drill floor, and indeed in some jurisdictions such manual operations are prohibited.

Thus, there is a need for new and improved apparatus and methods for tubular stabbing guides for tong assemblies.

SUMMARY

In one embodiment, a tubular stabbing guide includes a frame, a clamping assembly mounted to the frame, the clamping assembly including a plurality of guide members configured to receive a tubular and movable between an open position and a closed position, and a support plate configured to support a weight of the tubular, the support plate movable between an extended position and a retracted position.

In another embodiment, a method of handling tubulars includes inserting a pin end of a first tubular into a tubular stabbing guide, thereby aligning the pin end of the first tubular with a box end of a second tubular; moving a support plate of the tubular stabbing guide into an extended position, wherein the support plate is disposed between the pin end of the first tubular and the box end of the second tubular in the extended position; and supporting a weight of the first tubular using the support plate.

In another embodiment, a tong assembly configured to be mounted to a positioning system and for aligning a first tubular and a second tubular includes a power tong configured to receive a first tubular, a backup tong configured to receive a second tubular, a tubular stabbing guide configured to align the first tubular and the second tubular. The tubular stabbing guide includes a plurality of guide members movable between an open position and a closed position, wherein the plurality of guide members engages the second tubular in the closed position. The tubular stabbing guide also includes a support plate configured to support a weight of the first tubular, the support plate movable between an extended position and a retracted position.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

In the following description, numerous specific details are set forth to provide a more thorough understanding of the present disclosure. However, it will be apparent to one of skill in the art that the present disclosure may be practiced without one or more of these specific details. In other instances, well-known features have not been described in order to avoid obscuring the present disclosure.

Figure 1:
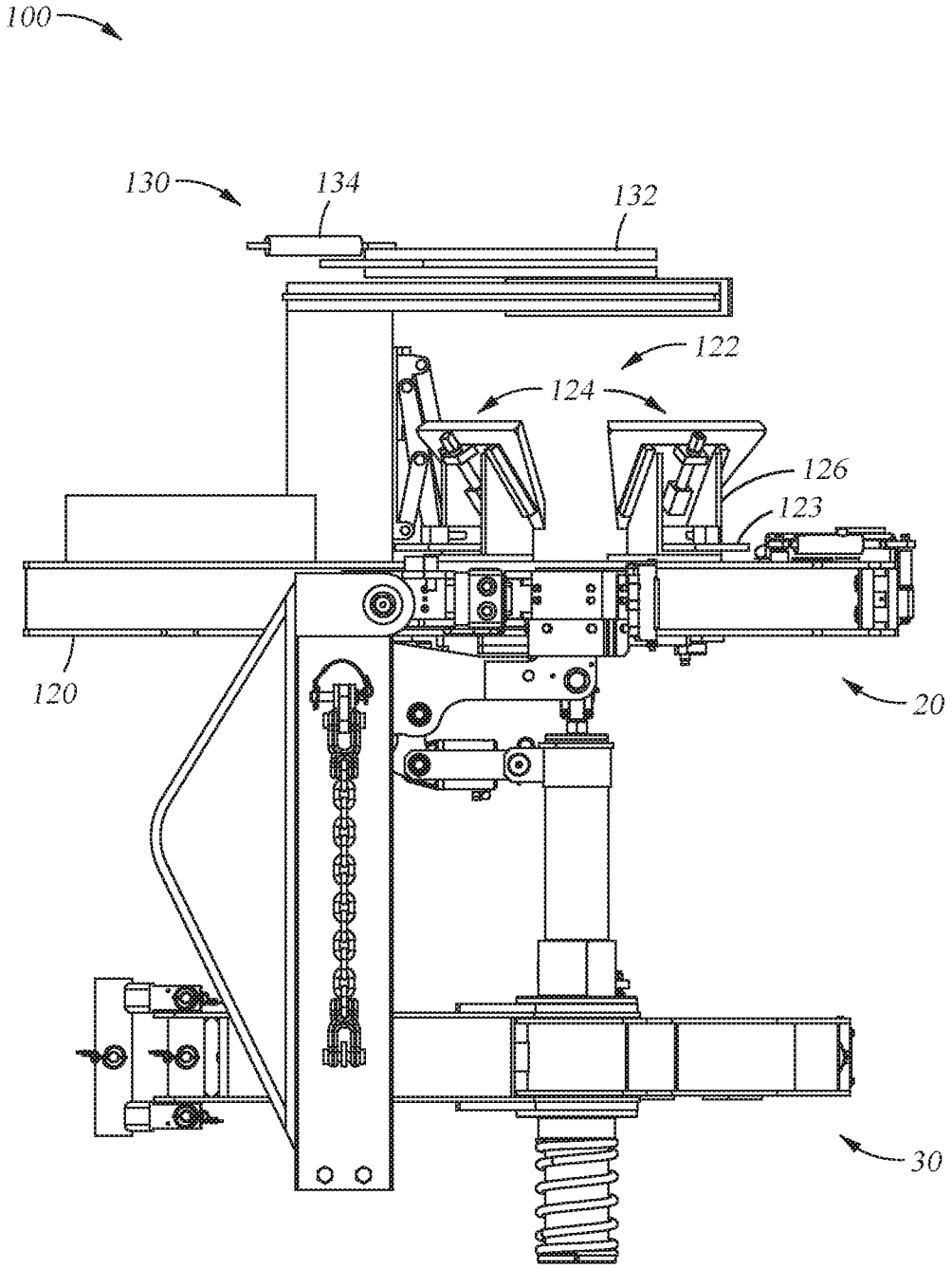
FIG. 1 illustrates a tubular stabbing guide in accordance with an embodiment of the present disclosure.
Figure 2:
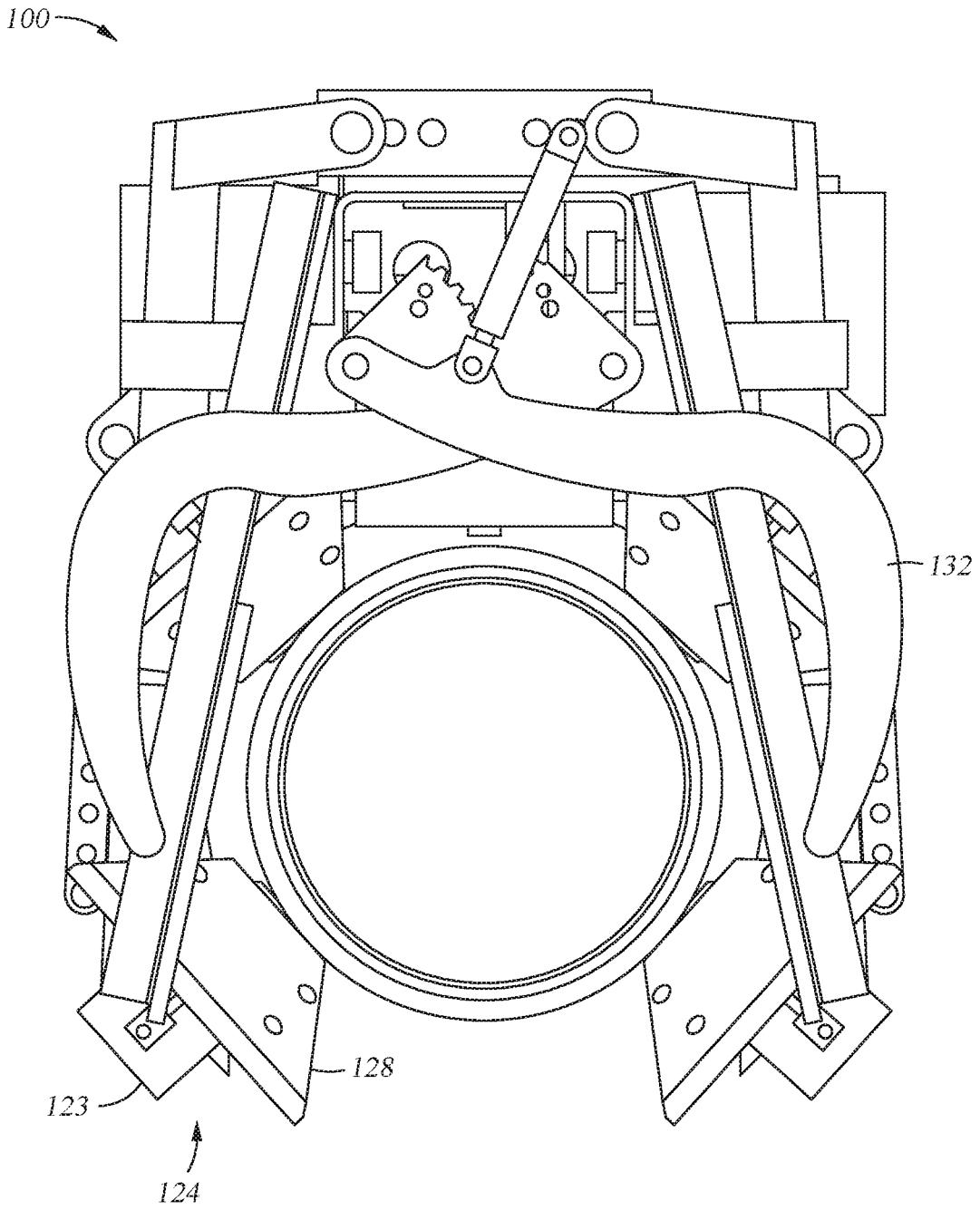
FIG. 2 illustrates a top down view of the tubular stabbing guide in accordance with an embodiment of the present disclosure.

FIGS. 1 and 2 illustrate a tubular stabbing guide 100 in accordance with an embodiment of the present disclosure. The tubular stabbing guide 100 may assist in aligning a pin end connection of a tubular joint with a box end connection of a tubular string.

The tubular stabbing guide 100 may be mounted on a tong assembly. In one embodiment, the tong assembly may be coupled to and moved by a positioning system, such as a power arm. The tong assembly includes a power tong 20 and a backup tong 30. The power tong 20 is configured to receive a pin end of a tubular joint and to engage and grip the pin end of the tubular joint. The backup tong 30 is configured to receive a box end of a tubular string and to engage and grip the box end of the tubular string or a tubular coupling disposed on an upper end of the tubular string. The power tong 20 and backup tong 30 may be used to makeup or breakout a connection between the tubular joint and the tubular string. In an alternative embodiment, a tubular handling apparatus configured to engage the tubular joint, such as a casing running tool, assists the tong assembly in breaking out or making up the threaded connection between the tubulars. In some embodiments, a tubular handling apparatus may include a wrenching unit configured to engage the tubular joint and a backup tong configured to engage the tubular string or tubular coupling. The wrenching unit may be configured to break out a threaded connection between the tubular joint and the tubular string or coupling.

The tubular stabbing guide 100 may align a pin end connection of a pipe joint or stand with a box end connection of a drill string. As the pipe joint is lowered, the tubular stabbing guide 100 directs the pin end connection towards the box end connection. The drill string is held and supported from the drill floor of a rig.

In an embodiment, the tubular stabbing guide 100 includes a frame 120. The frame 120 includes a clamping assembly 122 mounted to the frame 120. The clamping assembly 122 may include two or more clamp structures 124. Each clamp structure 124 is movably connected to the frame 120. In one embodiment, each clamp structure includes a tilt arm assembly 126. In another embodiment, each clamp structure 124 is fixed and/or stationary relative to the frame 120.

Figure 4A:
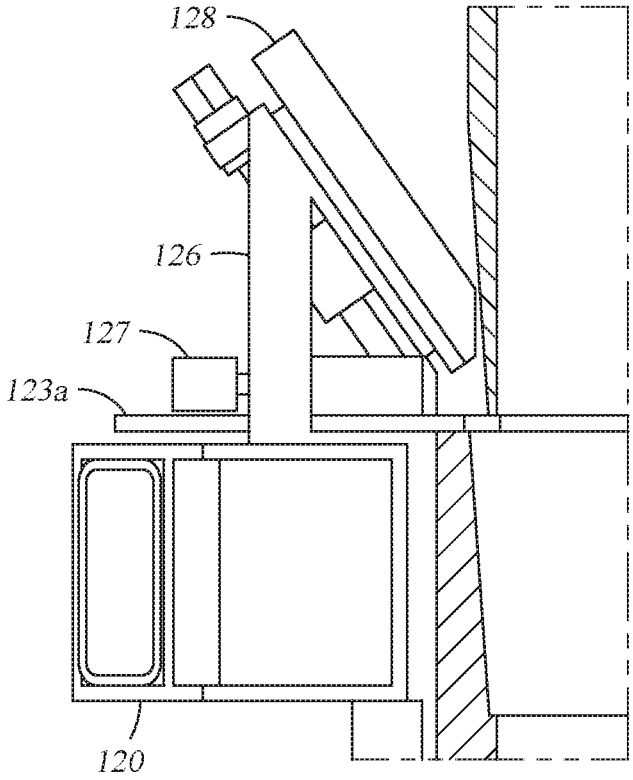
FIGS. 4A and 4B illustrate operation of the tubular stabbing guide and the support plate in accordance with an embodiment of the present disclosure.
Figure 4B:
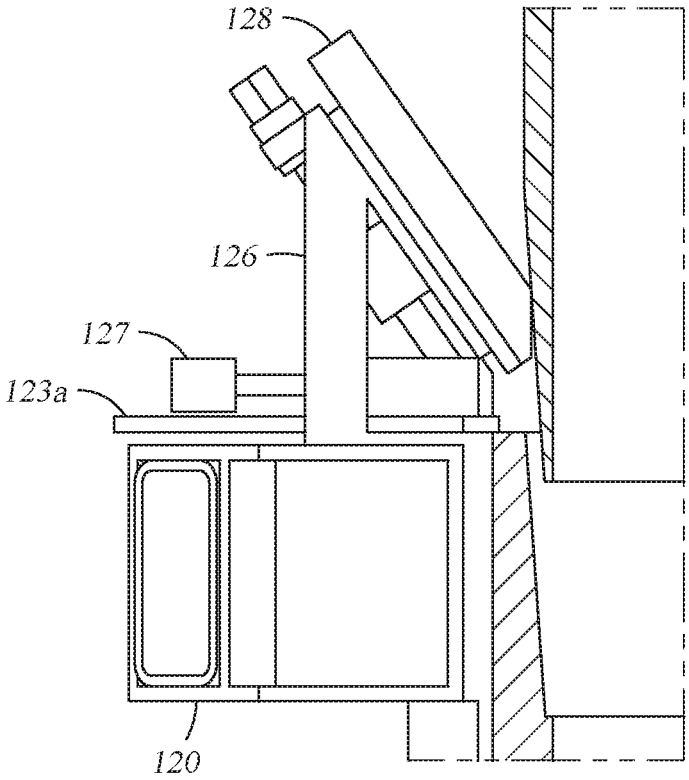

In the embodiment shown, the tubular stabbing guide 100 includes a plurality of guide members 128. The plurality of guide members 128 may be configured to receive a tubular. The guide members 128 are connected to an upper end of the tilt arm assembly 126, such as by one or more bolts. The plurality of guide members 128 may be coupled to the frame 120, such as via the tilt arm assembly 126. The guide member 128 may be formed of a tough plastics material. The guide member 128 may be disposed at an upper end of the tilt arm assembly 126. Each tilt arm assembly 126 may be movable between a retracted position and an engaged position. The guide members 128 may form a funnel to guide a pin end of a tubular joint being lowered into the box end of a tubular string. For example, the guide members 128 form a funnel above the box end of the tubular string to guide the pin end of a tubular joint as shown in FIG. 2. The guide members 128 are disposed about a circumference of the box end of the tubular string. The guide members 128 protect the upper end of the box connection and the lower end of the pin connection from damaging one another. For example, the guide members 128 extend over the upper end of the box connection, as shown in FIGS. 4A and 4B. The guide members 128 prevent the lower end of the pin connection from damaging the upper end of the box connection by aligning and ensuring the pin connection does not impact an upper end of the box connection as the tubular joint is lowered.

In an embodiment, each clamp structure 124 includes a clamp actuator, such as a piston and cylinder assembly. The clamp actuator may move the tilt arm assembly 126 between the retracted position and the engaged position. The tilt arm assembly 126 moves longitudinally from the retracted position until the respective guide member 128 is longitudinally above an upper end of the box connection. The clamp actuator next moves the tilt arm assembly 126 laterally inwards until the respective guide member 128 is positioned over the upper end of the box connection, as shown in FIG. 4A. A face of the guide members 128 is sloped inwards towards the box connection of the tubular string. The sloped face of the guide members 128 forms a funnel for receiving the pin connection of the tubular joint. The sloped face of the guide members 128 aligns the pin connection with the box connection, as shown in FIG. 4A.

In an embodiment, the sloped face of the guide member 128 has a linear, inner edge formed adjacent the tubular joint. In some embodiments, the planar element has a curved, inner edge corresponding to a curvature of the tubular joint. The sloped face of the guide member 128 has an upper, outer edge. The sloped face of the guide member 128 may slope inwards from the upper, outer edge to the inner edge. In the open position, the guide members 128 may be spaced apart from the pin end of the tubular joint. In the closed position, the guide members 128 may engage the pin end of the tubular joint, as shown in FIG. 4B.

Figure 3A:
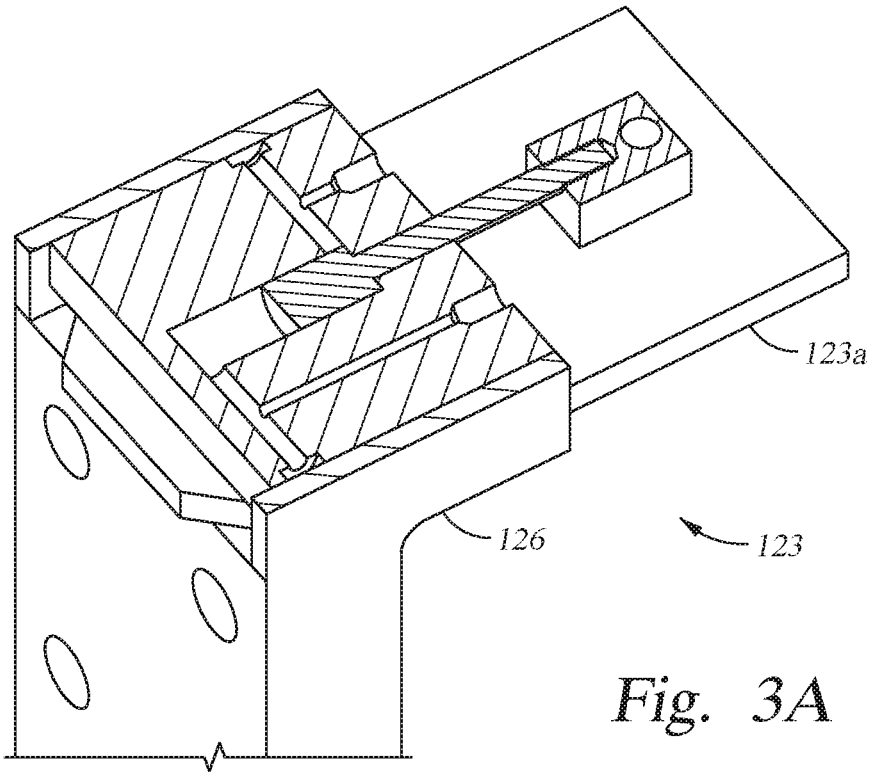
FIGS. 3A and 3B illustrate a support plate of the tubular stabbing guide in accordance with an embodiment of the present disclosure.
Figure 3B:
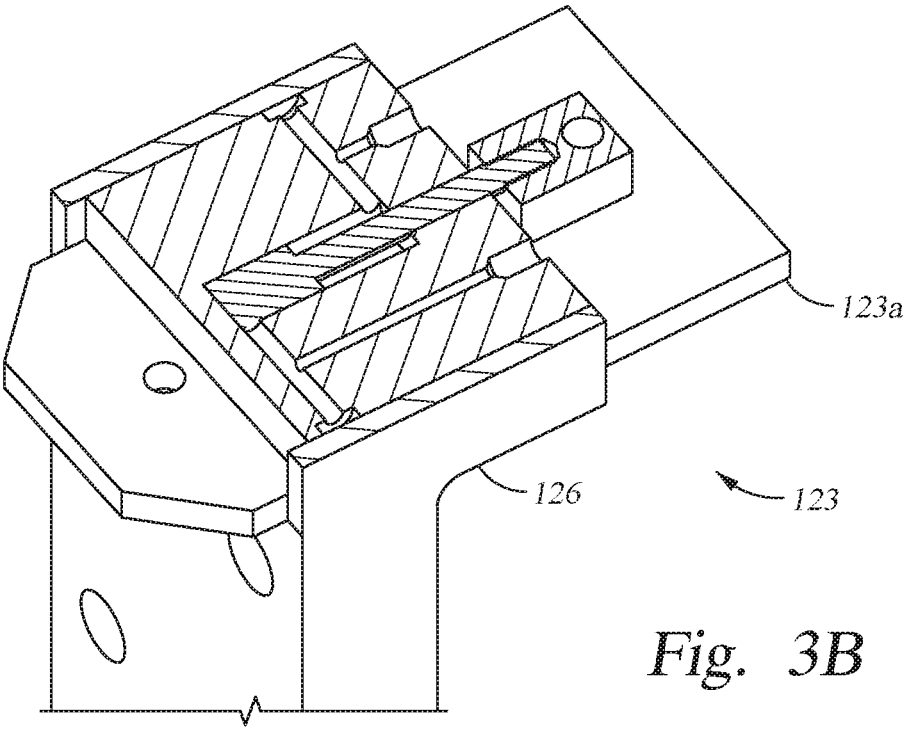
Figure 3C:
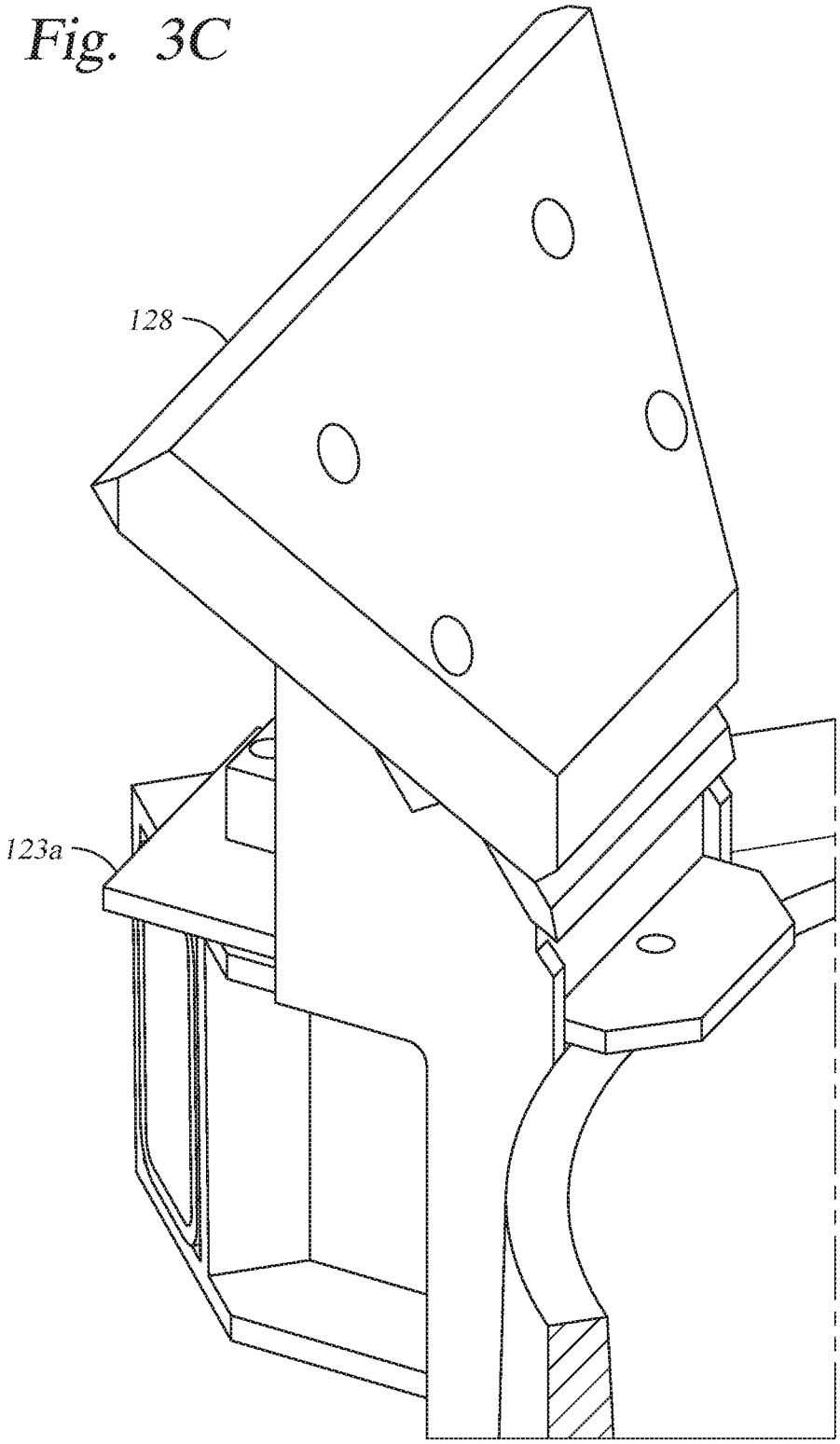
FIG. 3C illustrates a tilt arm assembly and a support plate of the tubular stabbing guide in accordance with an embodiment of the present disclosure.

FIGS. 3A-3C illustrate an embodiment of a support plate 123 of the tubular stabbing guide 100. The support plate 123 includes a plate element 123*a* and a support plate actuator. The plate element 123*a* may be formed of metal. The support plate actuator, such as piston and cylinder assembly 127 shown in FIG. 4A, is used to move the support plate 123 between an extended position, as shown in FIGS. 3B, 3C, and 4A, and a retracted position, as shown in FIGS. 3A and 4B. The plate element 123*a* is disposed in a slot of the tilt arm assembly 126. In some embodiments, the plate element 123*a* is flush with a face of the tilt arm assembly 126 in the retracted position. In some embodiments, the plate element 123*a* is substantially flush with a face of the tilt arm assembly in the retracted position, for example, extending five centimeters or less past the face of the tilt arm assembly. In some embodiments, the plate element 123*a* is retracted further inward from the face of the tilt arm assembly 126. In the extended position, the plate element 123*a* extends out of the slot of the tilt arm assembly 126. Each tilt arm assembly 126 includes support plate 123. In some embodiments, half or more of the tilt arm assemblies 126 include support plate 123. In some embodiments, alternating tilt arm assemblies 126 include support plate 123.

The support plate 123 may support a weight of the tubular joint. FIG. 4A shows the pin end connection of the tubular joint resting on the plate element 123*a* of the support plate 123. The plate element 123*a* is disposed between the pin end connection of the tubular joint and the box end connection of the tubular coupling or the tubular string. In the retracted position, an inner edge of the plate element 123*a* may be flush with an inner edge of the guide member 128. In some embodiments, the inner edge of the plate element 123*a* is further retracted from the inner edge of the guide member 128. In this embodiment, the support plate 123 is disposed below the guide member 128 on the tilt arm assembly 126. The support plate 123 may be disposed between an upper end of a coupling attached to the box end and a lower end of the pin end connection in the extended position.

Returning to FIGS. 1 and 2, the tubular stabbing guide 100 may include a catcher 130. The catcher 130 may be mounted to the frame 120 above the plurality of guide members 128. The catcher 130 may be configured to facilitate alignment of the tubular joint with the guide members 128 of the tubular stabbing guide 100. For example, the catcher 130 restrains lateral movement of the tubular joint as the tubular joint is lowered towards the guide members 128. The catcher 130 may include two or more arms 132. The arms 132 are pivotally movable between an open position and a closed position. The catcher 130 includes a catcher actuator 134, such as a piston and cylinder assembly, to move the two or more arms 132. In one embodiment, the two or more arms 132 move in a scissor action between the open position and the closed position. The two or more arms 132 engage the tubular joint when in the closed position.

According to one embodiment, in operation, a first tubular handling apparatus, such as an elevator, picks up a tubular joint and lift the tubular joint so the pin end of the connection hangs down over the tubular stabbing guide 100. The tubular joint is then lowered into the tubular stabbing guide 100. The catcher actuator is operated to move the two or more arms 132 to the closed position. The two or more arms 132 of the catcher 130 engage the tubular joint and facilitate alignment of the tubular joint with the guide members 128 of the tubular stabbing guide 100. For example, the arms 132 of the catcher 130 restrain lateral movement of the tubular joint as the tubular joint is lowered towards the guide members 128.

The clamp actuators are operated to move the tilt arm assembly 126 from the retracted position to the engaged position. Movement of the tilt arm assembly 126 brings the guide members 128 into engagement with the tubular joint. The guide members 128 are moved radially inwards over the box end of the tubular string.

Next, the support plate 123 is moved to the extended position, as shown in FIG. 3C. The support plate actuator 127 is operated to move the plate element 123*a* into the extended position. The plate element 123*a* is moved inwards to provide a rest shoulder for the tubular joint. The support plate 123 is moved radially inwards below the pin end of the tubular joint. In the extended position shown in FIG. 4A, the plate element 123*a* is disposed between the pin end of the tubular joint and a box end of the tubular coupling or tubular string. The tubular joint is then lowered through the tubular stabbing guide 100 to rest on the plate element 123*a* of the support plate 123. The tubular joint also rests on the plate elements 123*a* of the other tilt arm assemblies 126. As the tubular joint is lowered through the tubular stabbing guide 100, the guide members 128 engage the tubular joint. The tubular joint may engage either or both the sloped face or the inner edge of the guide members 128. Engagement with the guide members 128 aligns the tubular joint with the tubular string. The guide members 128 facilitate landing the tubular joint on the plate elements 123*a*. The support plate 123 supports a weight of the tubular joint. While the tubular joint rests on the plate elements 123*a*, a second tubular handling apparatus, such as a top drive or casing running tool, may be swapped out with the first tubular handling apparatus. The second tubular handling apparatus then engages the tubular joint. In some embodiments, a casing running tool is stabbed into the upper end of the tubular joint and slips of the casing running tool engage the tubular joint.

The second tubular handling apparatus lifts the tubular joint off of the support plate 123. The support plate 123 is moved to the retracted position by operating the support plate actuator 127, as shown in FIG. 4B. The planar elements 123*a* move radially outwards from beneath the pin end of the tubular joint. The support plate 123 is retracted at least until an inner edge of the planar elements 123*a* is flush with an inner edge of the guide members 128. In some embodiments, the support plate is further retracted until the inner edge of the planar elements 123*a* is further retracted from the inner edge of the guide members 128. The support plate 123 moves radially outward from beneath the pin end of the tubular joint.

The tubular joint is then lowered through the stabbing guide 100. The guide members 128 prevent the lower end of the pin end and the upper end of the box end from damaging each other. The guide members 128 align the pin end of the tubular joint with the box end of the tubular string as the tubular joint is lowered through the tubular stabbing guide 100. Once the pin end of the tubular joint is lowered into engagement with the box end of the tubular string, the threaded connection is madeup between the pin end and the box end.

In one or more of the embodiments described herein, a tubular stabbing guide includes a frame, a clamping assembly mounted to the frame, the clamping assembly including a plurality of guide members configured to receive a tubular and movable between an open position and a closed position, and a support plate configured to support a weight of the tubular, the support plate movable between an extended position and a retracted position.

In one or more of the embodiments described herein, the tubular stabbing guide further includes a catcher configured to engage a tubular.

In one or more of the embodiments described herein, the catcher is mounted on the frame above the plurality of guide members.

In one or more of the embodiments described herein, the catcher further includes a pair of jaws movable between an open position and a closed position, wherein the pair of jaws is configured to engage the tubular in the closed position.

In one or more of the embodiments described herein, the catcher further includes an actuator configured to move the pair of jaws between the open position and the closed position.

In one or more of the embodiments described herein, wherein the plurality of guide members engage a pin end of a tubular joint in the closed position.

In one or more of the embodiments described herein, the tubular stabbing guide further comprising an actuator configured to move the support plate between the extended position and the retracted position.

In one or more of the embodiments described herein, wherein each of the guide members has a linear inner edge.

In one or more of the embodiments described herein, the support plate including two or more planar elements.

In one or more of the embodiments described herein, wherein the number of planar elements of the support plate is equal to the number of guide members.

In one or more of the embodiments described herein, wherein the support plate is disposed below the plurality of guide members.

In one or more of the embodiments described herein, wherein an inner edge of the support plate is flush with an inner edge of a respective guide member when the support plate is in the retracted position.

In one or more of the embodiments described herein, wherein an inner edge of the support plate extends past an inner edge of a respective guide member when the support plate is in the extended position.

In one or more of the embodiments described herein, wherein each of the plurality of guide members is a planar element.

In one or more of the embodiments described herein, wherein each of the plurality of guide members is connected to a respective tilt arm assembly of the clamping assembly.

In one or more of the embodiments described herein, a method of handling tubulars includes inserting a pin end of a first tubular into a tubular stabbing guide, thereby aligning the pin end of the first tubular with a box end of a second tubular; moving a support plate of the tubular stabbing guide into an extended position, wherein the support plate is disposed between the pin end of the first tubular and the box end of the second tubular in the extended position; and supporting a weight of the first tubular using the support plate.

In one or more of the embodiments described herein, the method further includes moving a plurality of guide members to an engaged position with the first tubular, thereby facilitating alignment of the pin end of the first tubular with the box end of the second tubular.

In one or more of the embodiments described herein, the method further includes lowering the first tubular to rest the pin end on the support plate.

In one or more of the embodiments described herein, the method further includes lifting the first tubular off the support plate.

In one or more of the embodiments described herein, the method further includes moving the support plate to a retracted position.

In one or more of the embodiments described herein, a tong assembly configured to be mounted to a positioning system and for aligning a first tubular and a second tubular includes a power tong configured to receive the first tubular, a backup tong configured to receive the second tubular, a tubular stabbing guide configured to align the first tubular and the second tubular.

In one or more of the embodiments described herein, the tubular stabbing guide includes a plurality of guide members movable between an open position and a closed position, wherein the plurality of guide members engage the first tubular in the closed position; and a support plate configured to support a weight of the first tubular, the support plate movable between an extended position and a retracted position.

While the foregoing is directed to embodiments of the present disclosure, other and further embodiments of the disclosure may be devised without departing from the basic scope thereof, and the scope thereof is determined by the claims that follow.

The invention claimed is:

1. A tubular stabbing guide, comprising:

a frame;

a clamping assembly mounted to the frame, the clamping assembly including a plurality of guide members configured to receive a tubular and movable between an open position and a closed position; and a support plate configured to support a weight of the tubular, the support plate movable between an extended position and a retracted position, and wherein the support plate is disposed below the plurality of guide members.

2. The tubular stabbing guide of claim 1, wherein the plurality of guide members engage the tubular when in the closed position.

3. The tubular stabbing guide of claim 1, further comprising an actuator configured to move the support plate between the extended position and the retracted position.

4. The tubular stabbing guide of claim 1, wherein each of the guide members have a linear inner edge.

5. The tubular stabbing guide of claim 1, wherein each of the guide members comprises a planar element.

6. The tubular stabbing guide of claim 1, the support plate comprising two or more planar elements.

7. The tubular stabbing guide of claim 6, wherein the number of planar elements of the support plate is equal to the number of guide members.

8. The tubular stabbing guide of claim 1, wherein an inner edge of the support plate is flush with an inner edge of a respective guide member when the support plate is in the retracted position.

9. The tubular stabbing guide of claim 1, wherein an inner edge of the support plate extends past an inner edge of a respective guide member when the support plate is in the extended position.

10. The tubular stabbing guide of claim 1, wherein each of the plurality of guide members is connected to a respective tilt arm assembly of the clamping assembly.

11. The tubular stabbing guide of claim 1, further comprising a catcher configured to engage the tubular.

12. The tubular stabbing guide of claim 11, wherein the catcher is mounted on the frame above the plurality of guide members.

13. The tubular stabbing guide of claim 11, the catcher further comprising:

a pair of jaws movable between an open position and a closed position, wherein the pair of jaws is configured to engage the tubular in the closed position;

an actuator configured to move the pair of jaws between the open position and the closed position.

14. A method of handling tubulars, comprising:

inserting a pin end of a first tubular into a tubular stabbing guide, thereby aligning the pin end of the first tubular with a box end of a second tubular;

moving a support plate of the tubular stabbing guide into an extended position, wherein the support plate is disposed between the pin end of the first tubular and the box end of the second tubular in the extended position;

supporting a weight of the first tubular using the support plate; and lifting the first tubular off the support plate.

15. The method of claim 14, further comprising moving a plurality of guide members to an engaged position with the first tubular, thereby facilitating alignment of the pin end of the first tubular with the box end of the second tubular.

16. The method of claim 14, further comprising lowering the first tubular to rest the pin end on the support plate.

17. The method of claim 14, further comprising moving the support plate to a retracted position.

18. A tubular handling system, comprising:

a tong assembly, comprising:

a power tong configured to receive a first tubular;

a backup tong configured to receive a second tubular;

a tubular stabbing guide configured to align the first tubular and the second tubular, comprising:

a plurality of guide members movable both longitudinally and laterally relative to the power tong between an open position and a closed position, wherein the plurality of guide members engage the second tubular in the closed position; and a support plate configured to support a weight of the first tubular, the support plate movable between an extended position and a retracted position.

19. The tubular handling system of claim 18, further comprising:

a positioning system configured to move the tong assembly and tubular stabbing guide.

20. A tubular stabbing guide, comprising:

a frame;

a clamping assembly mounted to the frame, the clamping assembly including a plurality of guide members configured to receive a tubular and movable between an open position and a closed position;

a support plate configured to support a weight of the tubular, the support plate movable between an extended position and a retracted position; and a catcher configured to engage the tubular, wherein the catcher is mounted on the frame above the plurality of guide members.

* * * * *